United States Patent [19]

Brandewie et al.

[11] 4,308,659

[45] Jan. 5, 1982

[54] SINGLE LEAD INSERTION CONNECTOR BLOCK LOADING APPARATUS

[75] Inventors: Joseph E. Brandewie, Dunedin; Steven Feldman, Seminole, both of Fla.; Mark F. Jackson, Harrisburg, Donald N. Nyberg, Carlisle, Milton D. Ross, Harrisburg all of Pa.

[73] Assignee: AMP Incorporated, Harrisburg, Pa.

[21] Appl. No.: 152,020

[22] Filed: May 21, 1980

[51] Int. Cl.[3] ..... H01R 43/00

[52] U.S. Cl. ..... 29/748; 29/742; 29/759

[58] Field of Search ..... 29/748, 747, 742, 753, 29/754, 759, 564.1, 564.6, 564.7, 564.8, 884

[56] References Cited

U.S. PATENT DOCUMENTS

| | | | |
|---|---|---|---|
| 3,245,135 | 4/1966 | Netta | 29/748 |
| 3,817,127 | 6/1974 | Soeller | 81/9.51 |
| 4,055,889 | 11/1977 | Fusco et al. | 29/748 X |
| 4,064,624 | 12/1977 | Spangler | 29/753 |
| 4,089,405 | 5/1978 | Loomis et al. | 29/759 X |

*Primary Examiner*—Carl E. Hall

*Attorney, Agent, or Firm*—F. Brice Faller

[57] ABSTRACT

Block loader for inserting a plurality of terminated wire leads one at a time into a connector block by delivering wires laterally of their axes to a pair of feed wheels which engage the wire to drive it through a tunnel formed by the closure of a profiled lid against a platform and into a terminal receiving cavity in a connector block. Operations of lateral wire delivery, lid closure, and engagement of feed wheels to wire are effected by the linear motion of a single cam carriage in a single stroke without the use of switches or pneumatic actuators.

8 Claims, 18 Drawing Figures

36
41
39
37

12
8
10
28
26
36
24
30
26
18
4
5
20
126
23
33
32
22
34
17
16
15
14
6

SINGLE LEAD INSERTION CONNECTOR BLOCK LOADING APPARATUS

BACKGROUND OF THE INVENTION

1. Field of the Invention

The present invention relates to an improved machine for inserting a plurality of terminated wire leads into a connector housing.

2. Brief Description of the Prior Art

Wire insertion machines of the prior art are commonly combination machines which both crimp a terminal onto the wire and insert it into a connector. An example is U.S. Pat. No. 4,074,424, which at the insertion stage utilizes a pair of wire grippers which grip the wire behind the terminal and move it toward a cavity in a housing indexed to receive the terminal. U.S. Pat. No. 4,164,065 utilizes a push member which bears on the terminal itself, and is an improvement over the former patent insofar as a wire in the apparatus of the former will buckle if the wire is not sufficiently stiff or large gauge. Both of the above are directed to connector housings having a single row of cavities. Other apparatus utilizing gripping jaws which clamp the wire and move it towards a housing include U.S. Pat. Nos. 3,329,002 and 3,964,147. The latter is directed to a multiple row connector. All of the above utilize pneumatic pistons actuated by electrical sensing switches which signal the completion of a previous operation.

U.S. Pat. Nos. 4,055,889 and 4,087,908 disclose a "Connector Harness Assembly Machine" which also utilizes jaws which grip the wire behind the terminal and move it toward a cavity in a housing, and further incorporates a test probe which runs an electrical continuity check to assure the terminal is inserted.

None of the prior art describes an insertion machine which utilizes a remote pair of feed wheels in combination with a tunnel to load a terminated wire into a connector housing.

SUMMARY OF THE INVENTION

The present invention utilizes feed wheels which move into contact with a terminated wire and feed it through a guide tunnel to a cavity in a connector block or housing. The guide tunnel closely accommodates the wire and assures that it does not buckle due to resistance which the terminal meets while entering the cavity. The wheels have a reversing feature which permits a pulltest to assure the terminal is retained in the housing. A wire is delivered to the feed wheels by a transfer carriage which advances a plurality of wires from a remote point. While wires are advancing, a lid with a profiled channel begins to close onto a platform, thus forming a tunnel over the leading end of a wire which has been fully advanced to a position above the wheels. The wheels then move up to flank the wire then move together to engage the wire to propel it toward a cavity in a terminal housing at the opposite end of the tunnel.

It is an object of the present invention to provide means for delivering the wires to the feed wheels, closure of the lid to position the lead and form the guide tunnel, and engagement of the feed wheels to the wire by the continuous linear movement of a carriage in a single stroke without the use of switches or pneumatic actuators.

It is an object of the present invention to provide adjustable means for driving the feed wheels at the proper power and speed to fully insert a given terminal into a cavity in a housing without damage to any component, and to stop the feed wheels when insertion is completed.

Another object of the invention is to load wire leads into a connector having closely spaced terminals by removal of the driving force from the congested area of wires already loaded.

It is a further object of the present invention to enable the feed wheels to reverse and check that the terminal is properly inserted.

It is another object of the present invention to form a guide tunnel about the terminated end of the wire prior to actuation of the feed wheels.

It is yet another object of the present invention to provide means for clearing a previously inserted wire from the guide wheels and tunnel prior to positioning the next advancing wire for insertion.

It is a further object of the present invention to provide means for aligning a wire on the platform so that the lid closes with the wire in the channel.

These and other objects of the invention are described in the preferred embodiment below and are shown in the accompanying drawings in which FIG. 1 is a general perspective of the block loader.

DESCRIPTION OF THE PREFERRED EMBODIMENT

Figure 1:
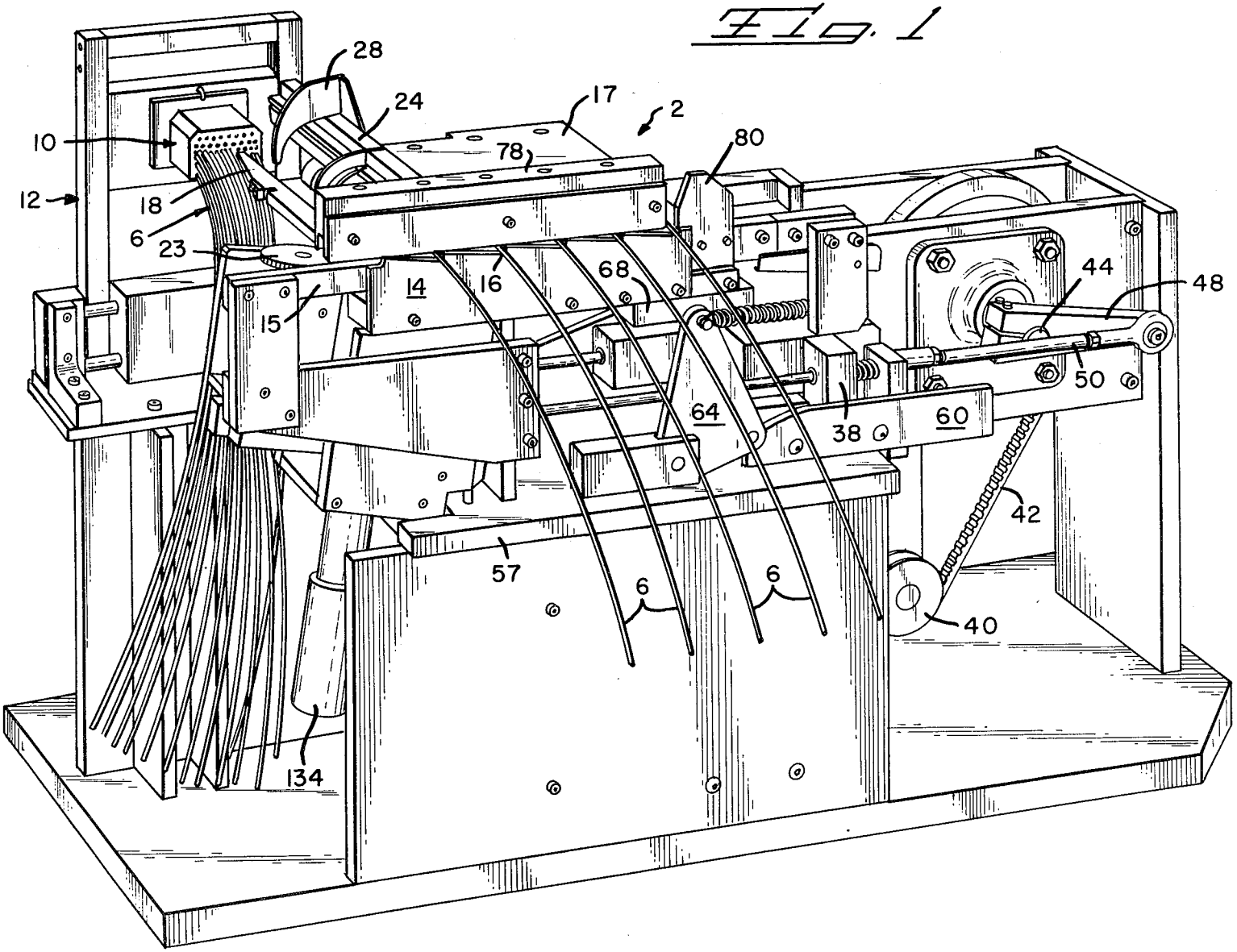
Figures 2, 2A:
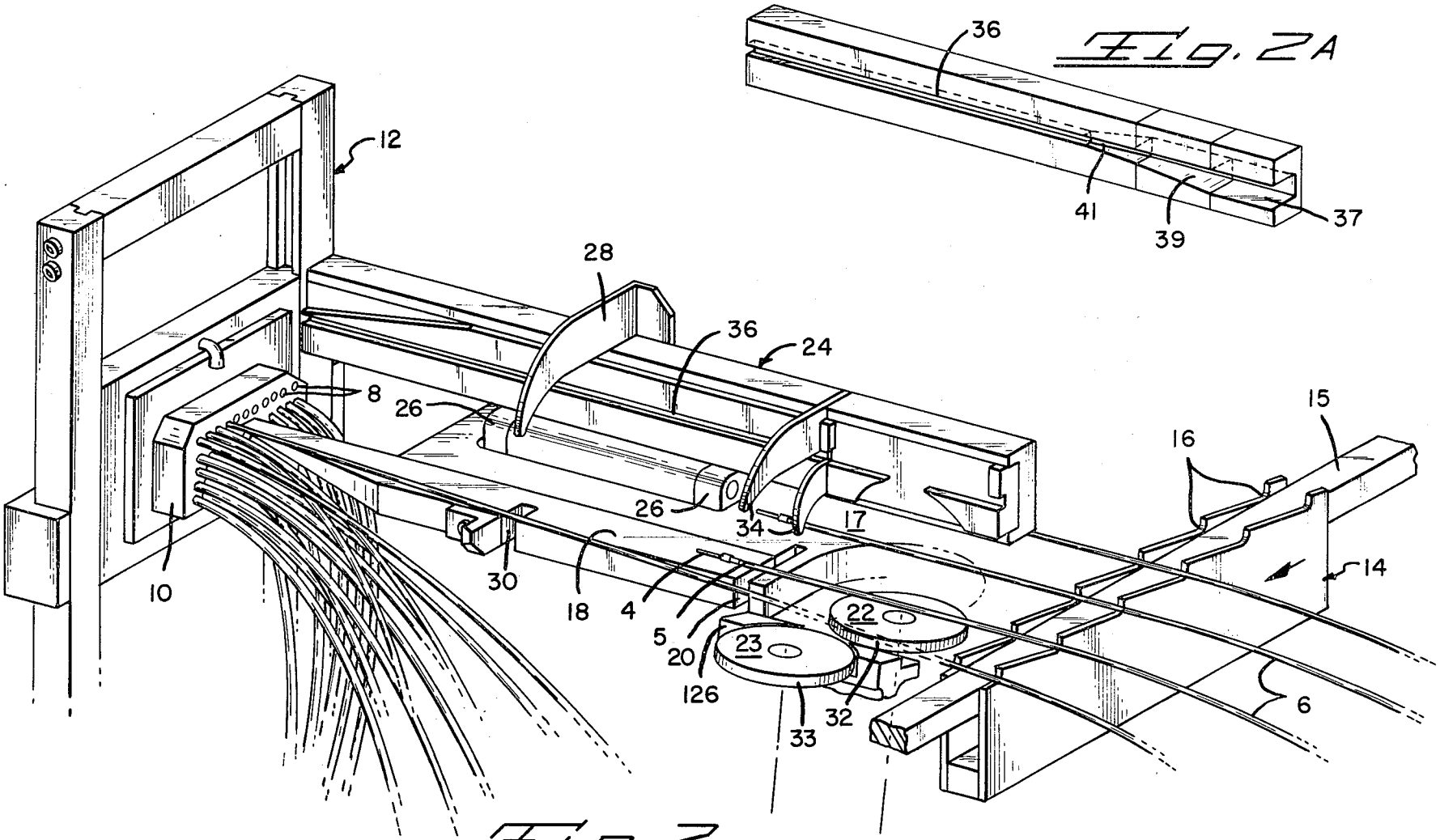
FIG. 2 is a perspective of the insertion guide with the lid open as the wire transfer carriage moves a wire into feed position on the guide platform.
FIG. 2A is a perspective of an alternative guide channel for use with square terminals.

Referring first to FIGS. 1 and 2, the block loader 2 of the preferred embodiment is designed to insert the terminals 4 on the leading ends 5 of wires 6 into terminal receiving cavities 8 in a connector block or housing 10 which is adjustably stationed in a housing support 12. Prior to insertion, the wires 6 are delivered laterally by a wire transfer carriage 14 having notches 16 therein which cradle the wires. The carriage moves the wires across track 15 and stops when the wire has come to rest on guide platform 18 where the wire lies across wire locating slot 20 with its leading end 5 just beyond the slot. Here the wire is roughly aligned for insertion by the notches 16 in the wire transfer carriage 14. The trailing end of the previously inserted wire is moved clear of the wire locating slot 20 in the same motion of the wire transfer carriage 14.

Figure 3:
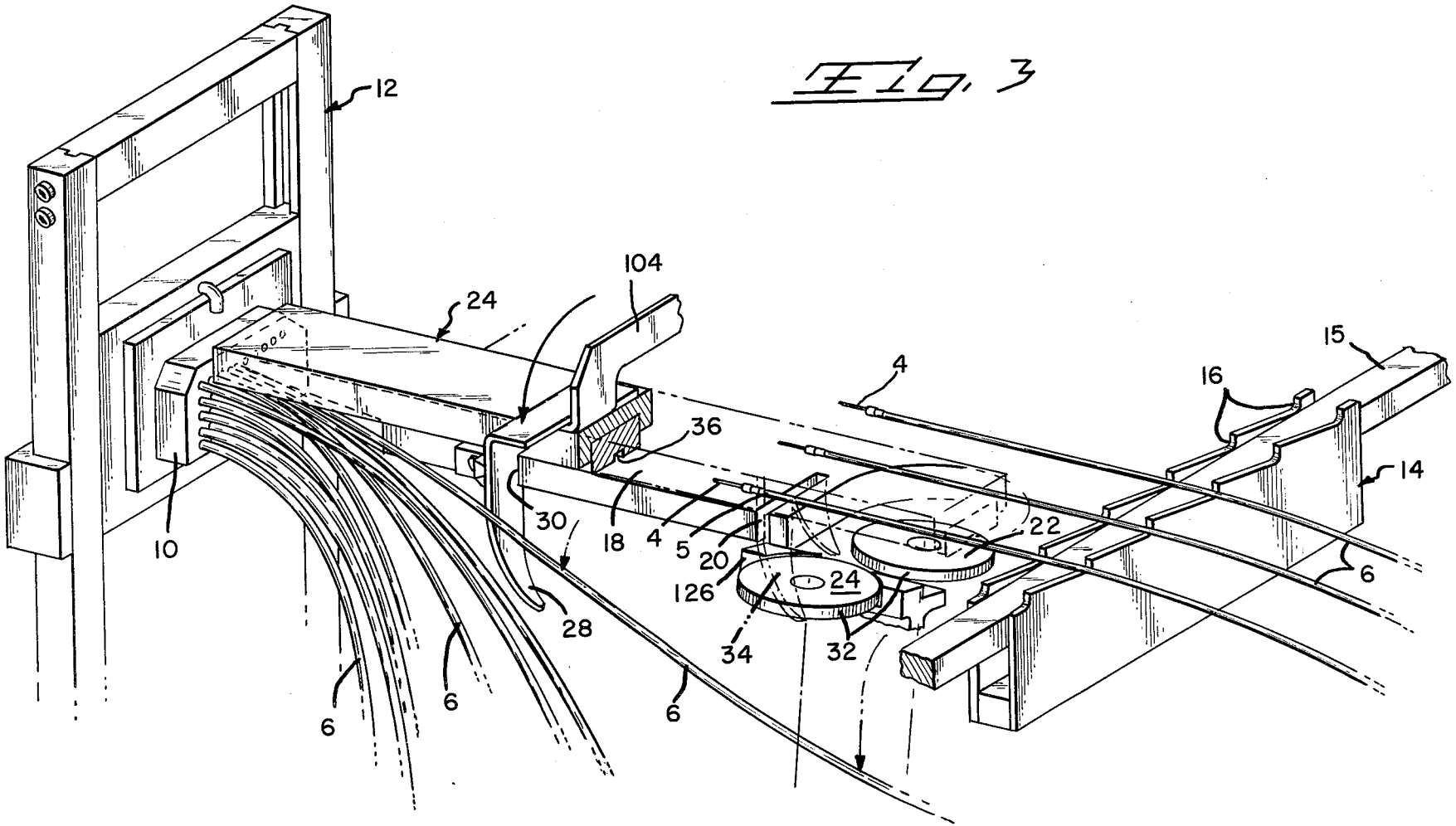
FIG. 3 is a cutaway perspective of the insertion guide as the lid closes removing the last wire loaded and positioning the next wire for loading.
Figure 4:
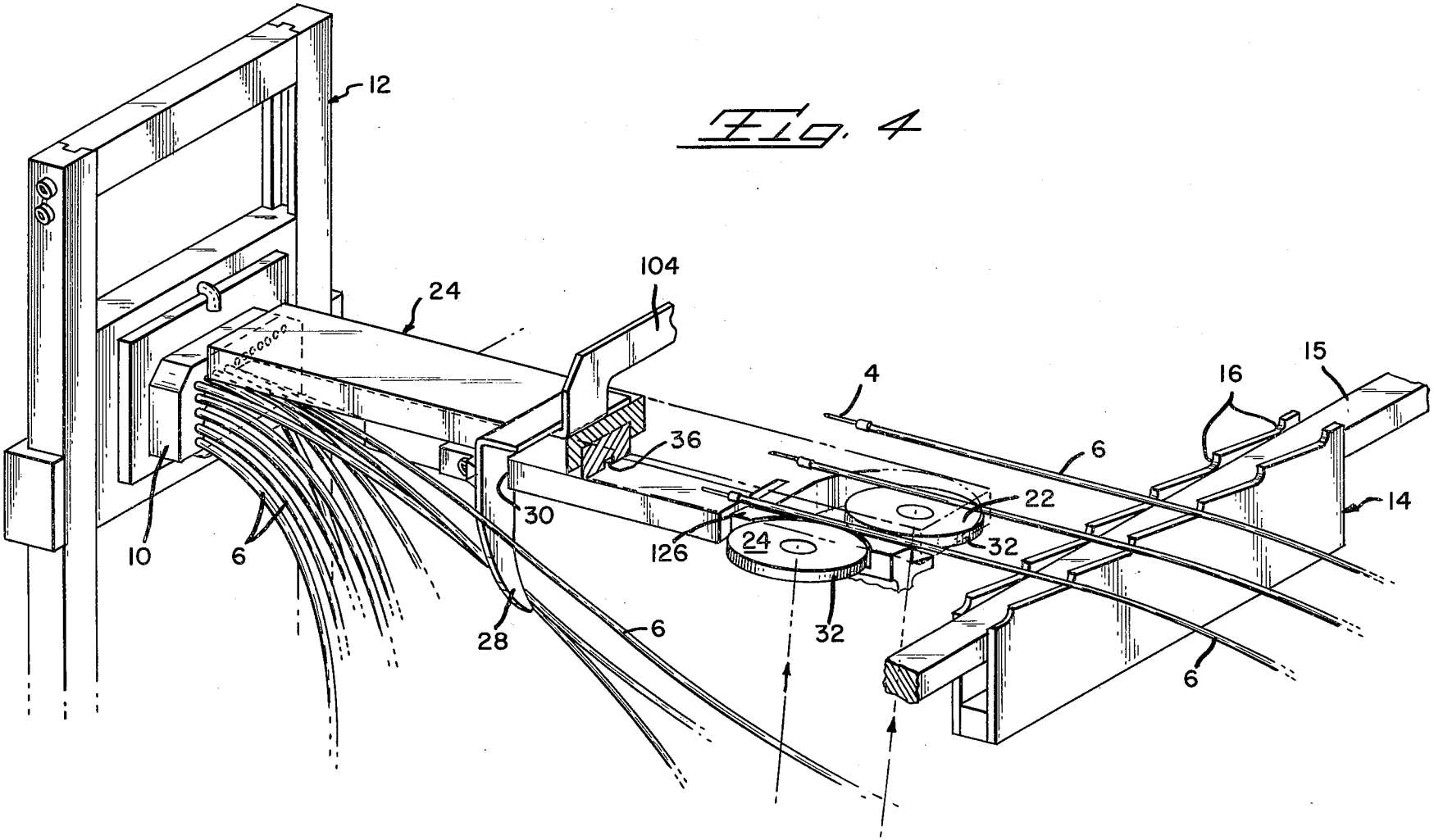
FIG. 4 is a cutaway perspective of the insertion guide as the feed wheels move up to flank the wire.
Figure 5:
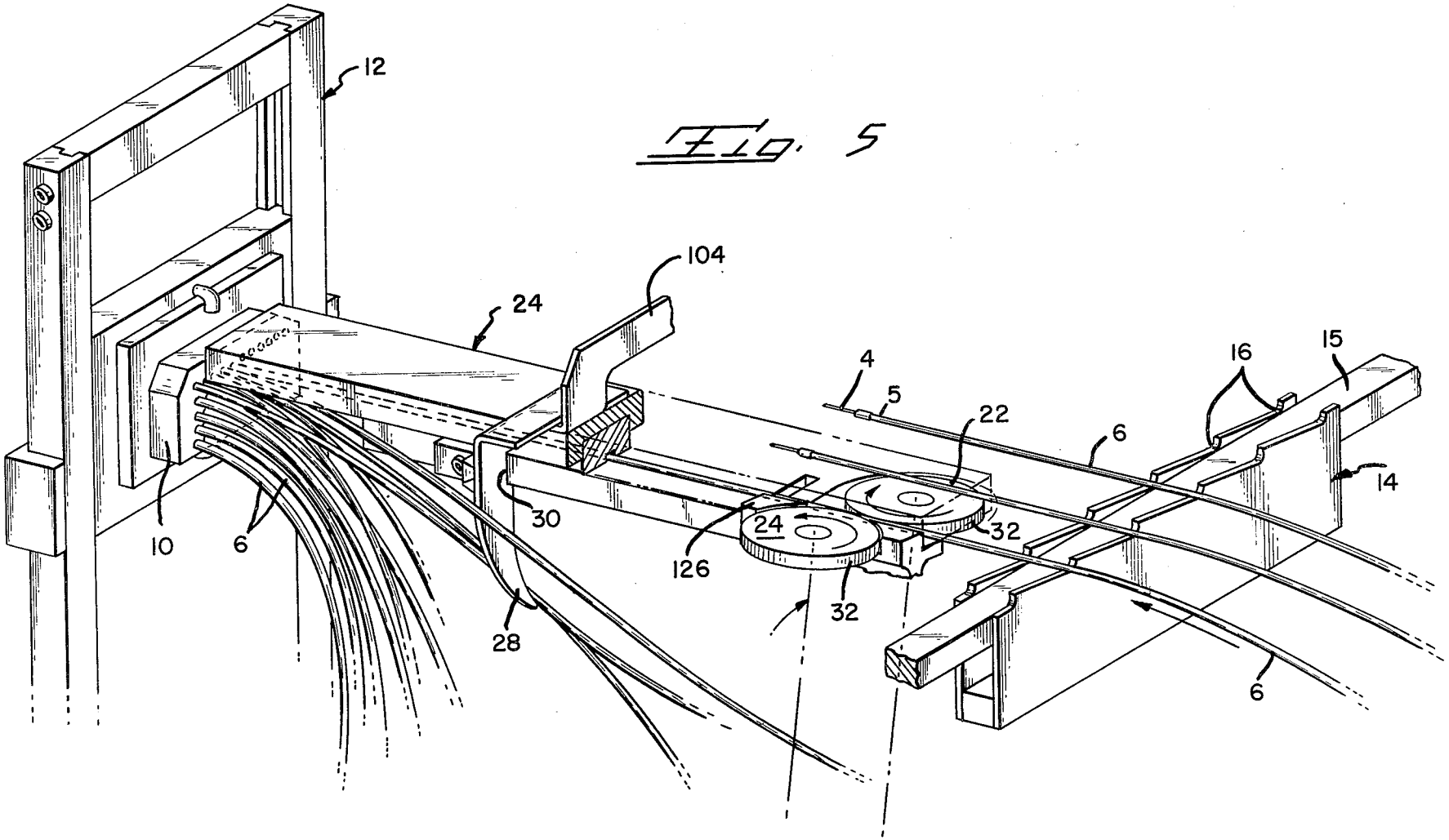
FIG. 5 is a cutaway perspective of the insertion guide as the feed wheels engage the wire and load a terminal into a cavity in the connector block.

At this point, the insertion guide lid 24 is closed against the guide platform 18 by means of hinges 26 on delivery platform 17 and linkage means to be described later. This forms the insertion guide. During closure of the insertion guide lid 24, wire locating fingers 34 move into wire locating slot 20 and align the wire 6 into guide channel 36 in the lid which forms a tunnel when closed against the guide platform 18. The channel 36 of the preferred embodiment, FIG. 2, has a uniform cross-section throughout and is intended for use with a terminated lead which does not require radial orientation. FIG. 2A is an alternative channel profile which employs an enlarged channel section 37 and inclined surfaces 39, 41 which radially orient a square connector as will be discussed later. The channelled portion of the lid is interchangeable for different connectors and is in three sections in the alternative embodiment to facilitate machining the channel. During lid closure, an ejector arm 28 moves into an ejector slot 30 thereby pushing the previously inserted wire clear of the guide platform. Now the wire is aligned in the tunnel as shown in FIG. 3, and is ready for engagement of feed wheels 22, 23. The feed wheels are then elevated to the position of FIG. 4 where their circumferential surfaces 32, 33 are adjacent to the wire to be inserted into a cavity 8 in the connector housing 10, the housing having been repositioned in the support 12 for reception of a wire into the next vacant cavity. This is accomplished manually in this embodiment, but may be interlocked with wire feed for automatic positioning. Note that the wheel carriage 126 and insertion guide lid 24 are profiled such that the guide for the wire is complete on either side of the wheels, which prevents wire buckling in this area during insertion. Now the wheels are moved together so that their circumferential surfaces 32, 33 engage the wire as shown in FIG. 5. The wheels are then rotated in opposite directions by an electric motor 134, to be discussed later, and the wire is moved toward the connector housing 10 until the terminal is inserted into a cavity 8 therein at which point the wheels stop. The wheels are then reversed for a brief period of time to exert a pull test on the wire to ascertain that the terminal is retained in the cavity in the connector housing. The wheels then return to their original position as the insertion guide lid 24 is raised from the guide platform 18 and the wire transfer carriage 14 returns to commence another cycle. Means for performing the functions described in the foregoing will be described in more detail in ensuing paragraphs.

Figure 6:
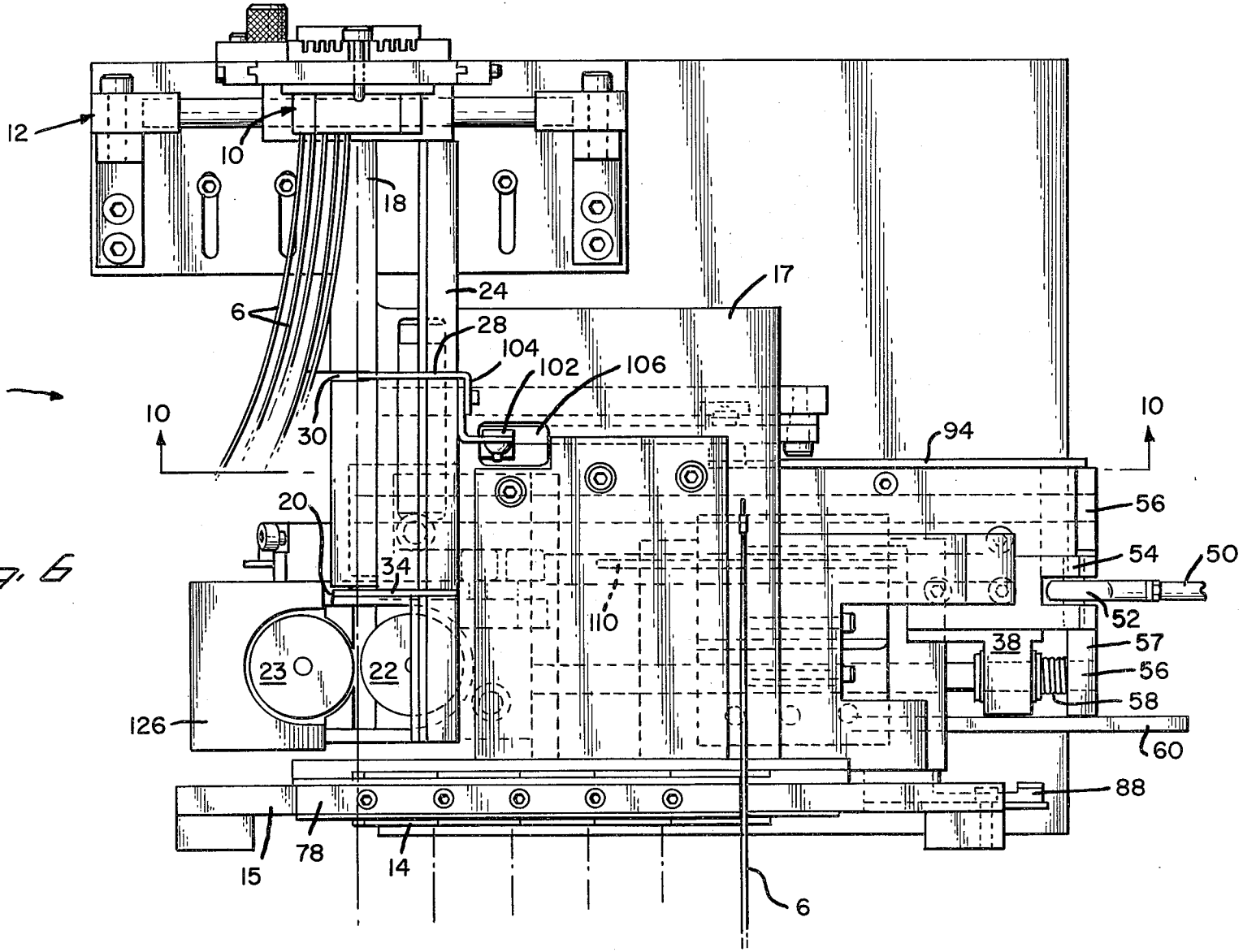
FIG. 6 is a top view of the block loader with the lid in the open position and the cam carriage fully to the right.
Figure 7:
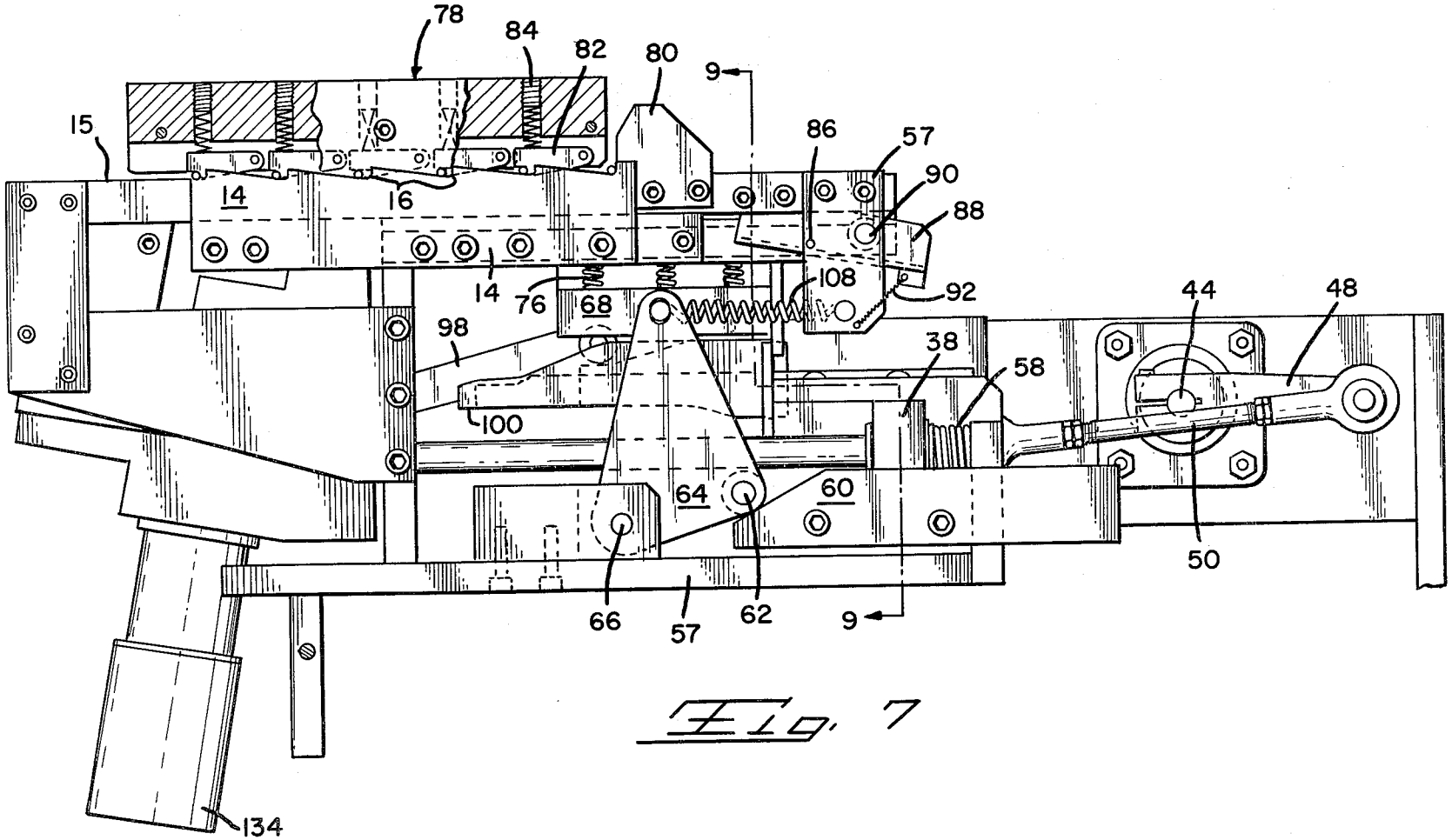
FIG. 7 is a partial side view of the block loader with the bearing block partially cut away, at the beginning of the wire feed stroke.
Figure 8:
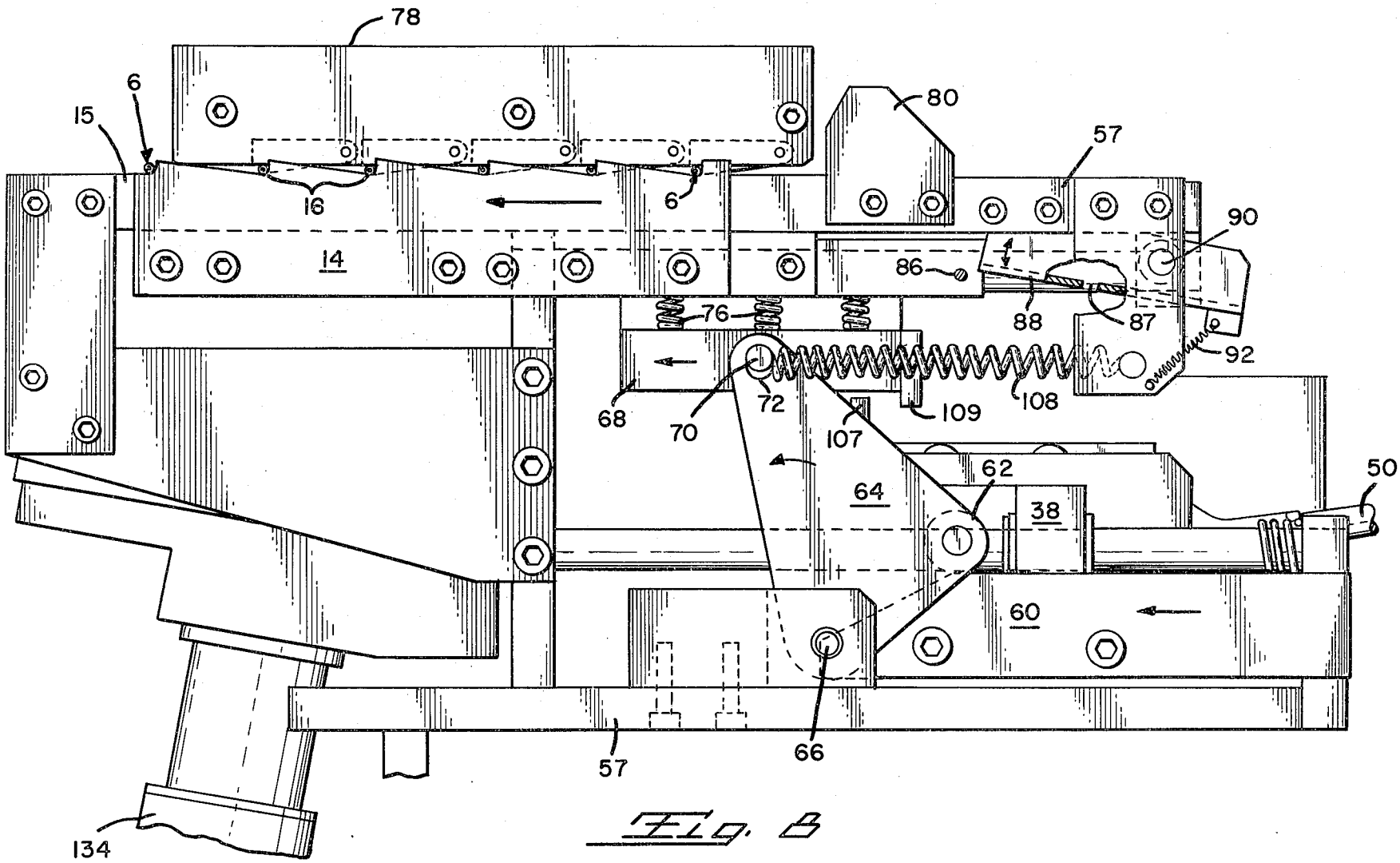
FIG. 8 is a side view of the wire transfer carriage at the end of the wire feed stroke.
Figure 8A:
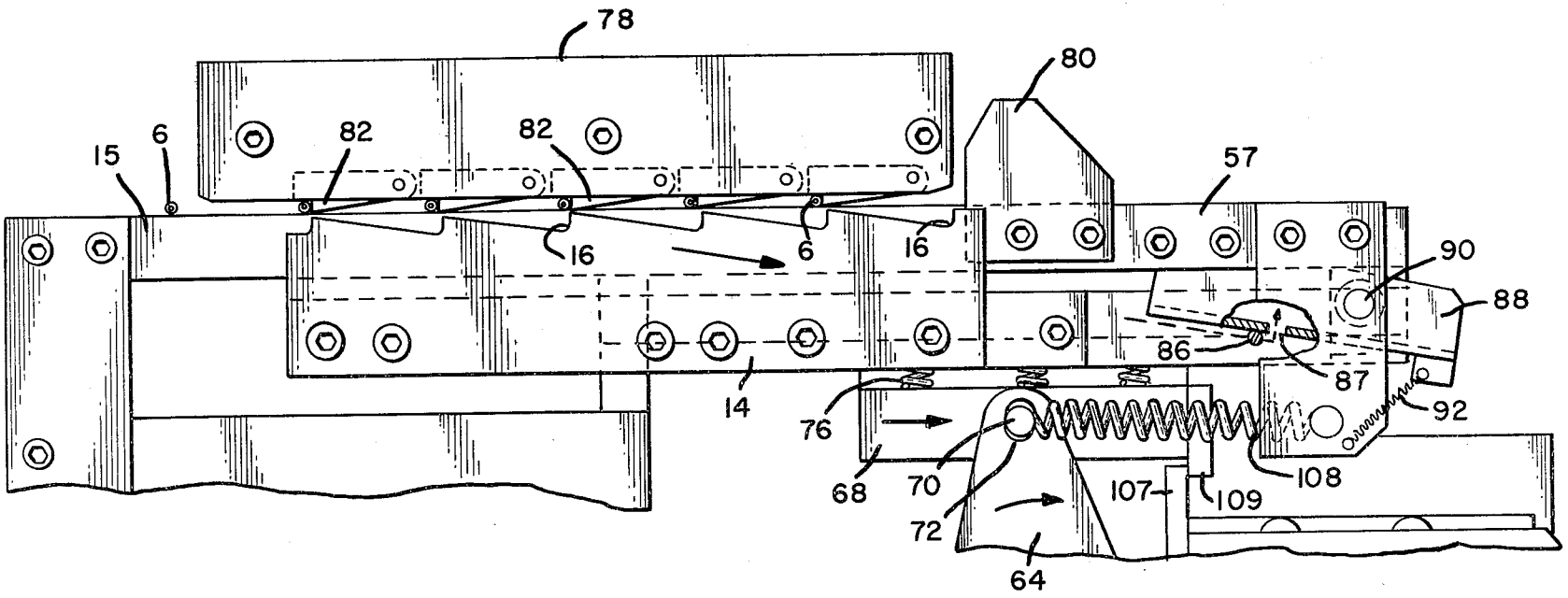
FIG. 8A is a side view of the wire transfer carriage near the end of the return stroke.
Figure 9:
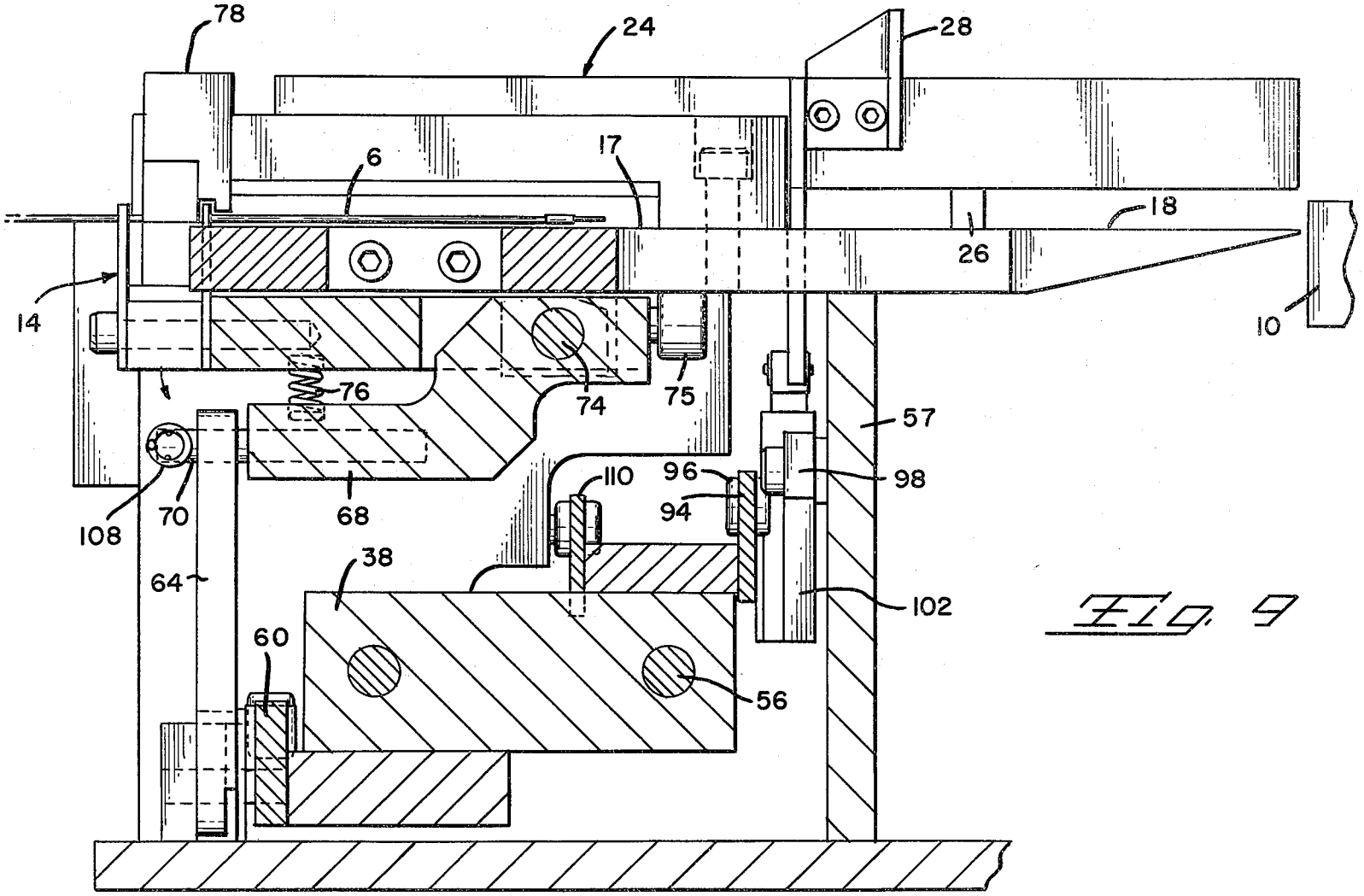
FIG. 9 is an end cross section taken along 9—9 of FIG. 7.

Referring again to FIG. 1, an electric motor turns a crank shaft 44 by means of a belt drive 42. The motor runs continuously and is intermittently disconnected from the crank shaft 44 by a clutch on the crank shaft (not visible). Referring to FIG. 7, the rotational movement of the crank shaft 44 is translated to linear movement of a cam carriage 38 by means of a crank 48 and a connecting rod 50. The connecting rod 50 is connected to a rod 54 in the cam carriage 38 by means of ball and socket joint 52 as shown in FIG. 6. The connecting rod 50 carries a spherical socket cup and the rod 54 has a ball thereon (not visible). The cam carriage 38 has a series of linear cams mounted on it which will be described in the order of their operation. Referring to FIGS. 7 and 8, wire transfer cam 60 acts on wire transfer cam follower 62 which causes take up arm 64 to rotate counterclockwise about wire transfer cam pivot 66 which is mounted to the frame 57 of the block loader. The geometry of the take up arm 64 translates the movement of the cam carriage to a more limited linear movement of a platen 68 mounted on the top end of the arm 64 by a slot track 72 and a pin 70 on the platen. The platen is connected pivotally to the wire transfer carriage 14 by means of a rail 74 shown sectionally in FIG. 9, and rides underneath the delivery platform 17 on a roller 75. As the platen 68 and carriage 14 move to the position of FIG. 8, a bypass cam follower 86 riding along the top of a bypass cam 88 causes the counterclockwise deflection of the bypass cam 88 about a bypass cam pivot 90 mounted on the frame 57. The counterclockwise rotation of the bypass cam 88 is readily allowed by bypass cam return spring 92, which is a very light action spring. Thus, there is not relative vertical movement between the platen 68 and the wire transfer carriage 14 on the wire delivery stroke. At the beginning of this stroke, as shown in FIG. 7, a wire is dropped between the guide plate 80 and the bearing block 78 which is attached to the frame 57. Leftward movement of the wire transfer carriage 14 causes pawls 82 to move vertically against bearing springs 84 in the bearing block 78 which holds the wires being delivered into the notches 16 in the transfer carriage 14 as the carriage pushes the wires across track 15. Later, when the transfer carriage 14 returns to get another wire, the bypass cam follower 86 rides down the underside of the bypass cam which is held stationary by the frame 57 of the block loader. This causes a vertical deflection of the transfer carriage toward the platen 68 which compresses the platen springs 76, as shown in FIG. 8A, preventing damage to the wires on the track 15 between the transfer carriage 14 and the bearing block 78. The return stroke of the transfer carriage is effected by a striker 107, mounted on the cam carriage, which bears against a strike plate 109, mounted on the platen. This motion is assisted by a transfer carriage return spring 108 mounted between the pin 70 on the platen and the frame 57 of the block loader. When the return stroke is completed, the bypass cam follower 86 will pass upward through slot 87 in the bypass cam 88. The transfer carriage is then in the position of FIG. 7 again.

Figure 10:
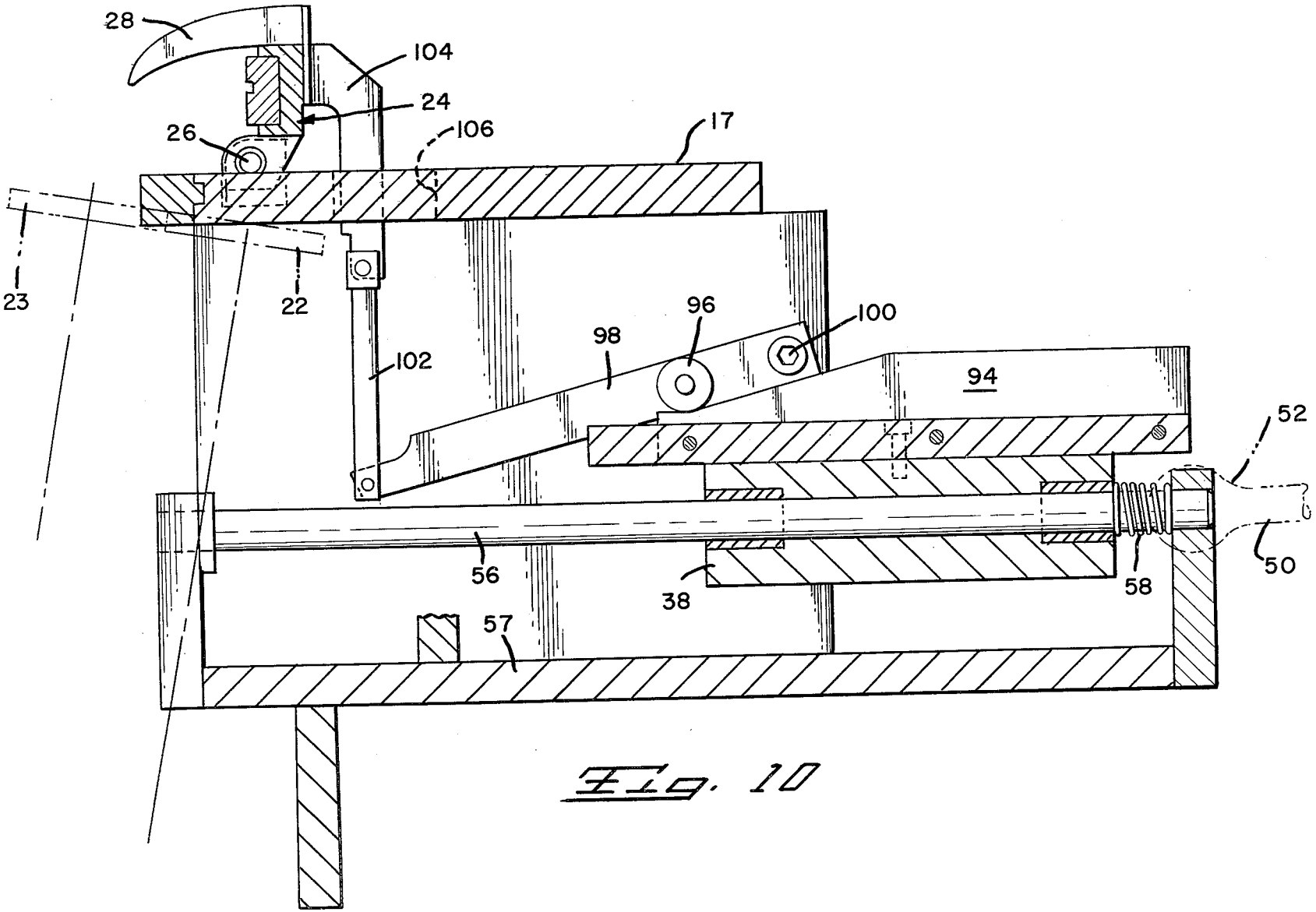
FIG. 10 is a side cross section taken along 10—10 of FIG. 6 at the beginning of the lid cycle.
Figure 11:
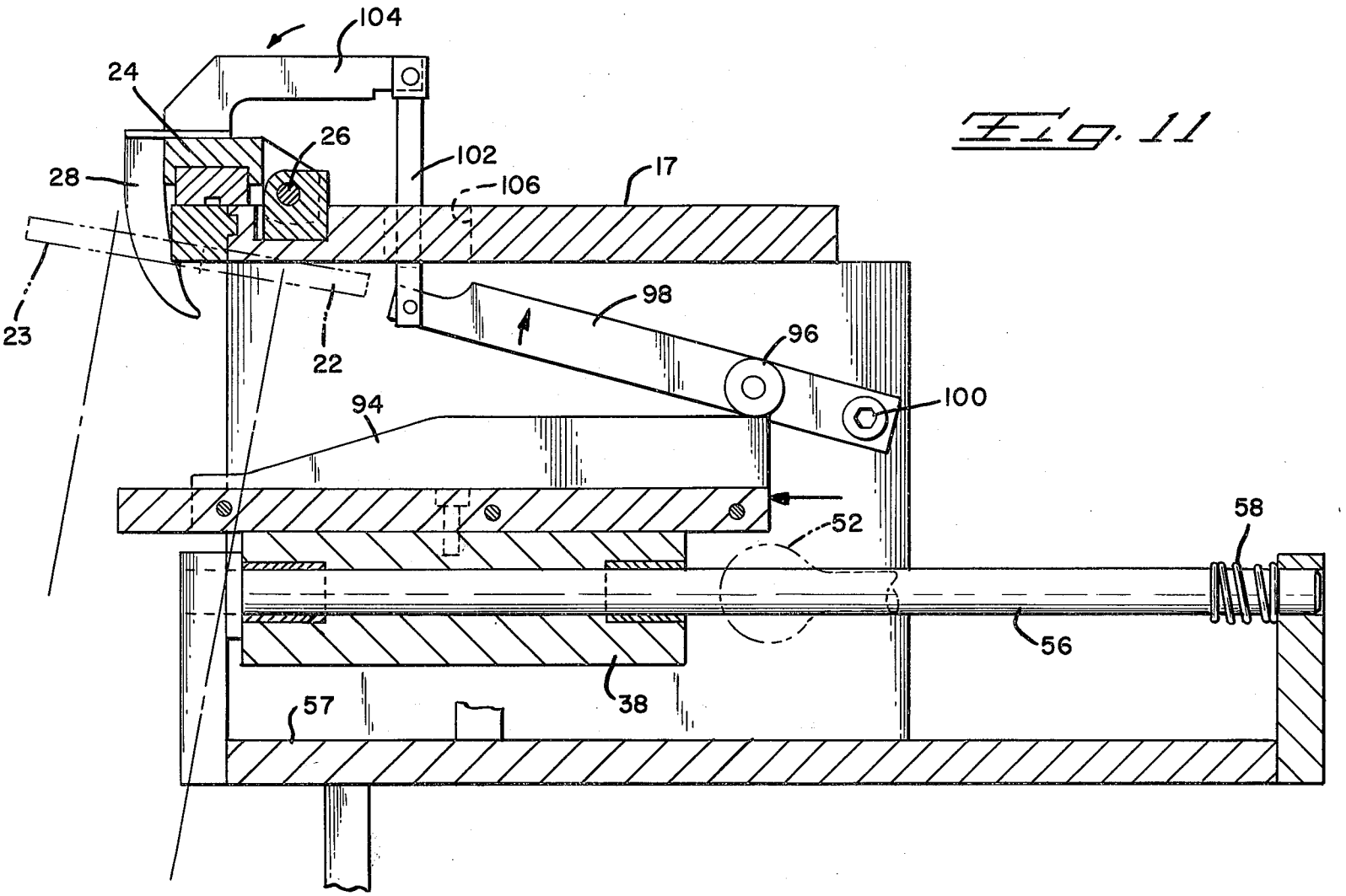
FIG. 11 is similar to FIG. 10, taken as the lid is fully closed.

Following the engagement of the wire transfer cam 60 to the wire transfer cam follower 62, the lid cam 94 engages the lid cam follower 96, as shown in FIG. 10. This causes the lid cam follower arm 98 to pivot clockwise about the pivot 100 causing upward vertical movement of the adjustable link 102 located at the opposite end the follower arm 98 from the pivot 100 and thus causes a pivot arm 104 to swing counterclockwise about hinge 26. This action effects the previously described lid closure, as shown in FIG. 11. The adjustable link 102 permits adjustment of the lid linkage for positive lid closure without undue stress on any of the linkage components. An elongated slot 106 in the delivery platform 17 permits passage of the pivot arm 104 as the lid is closed. See FIG. 11.

Figure 12:
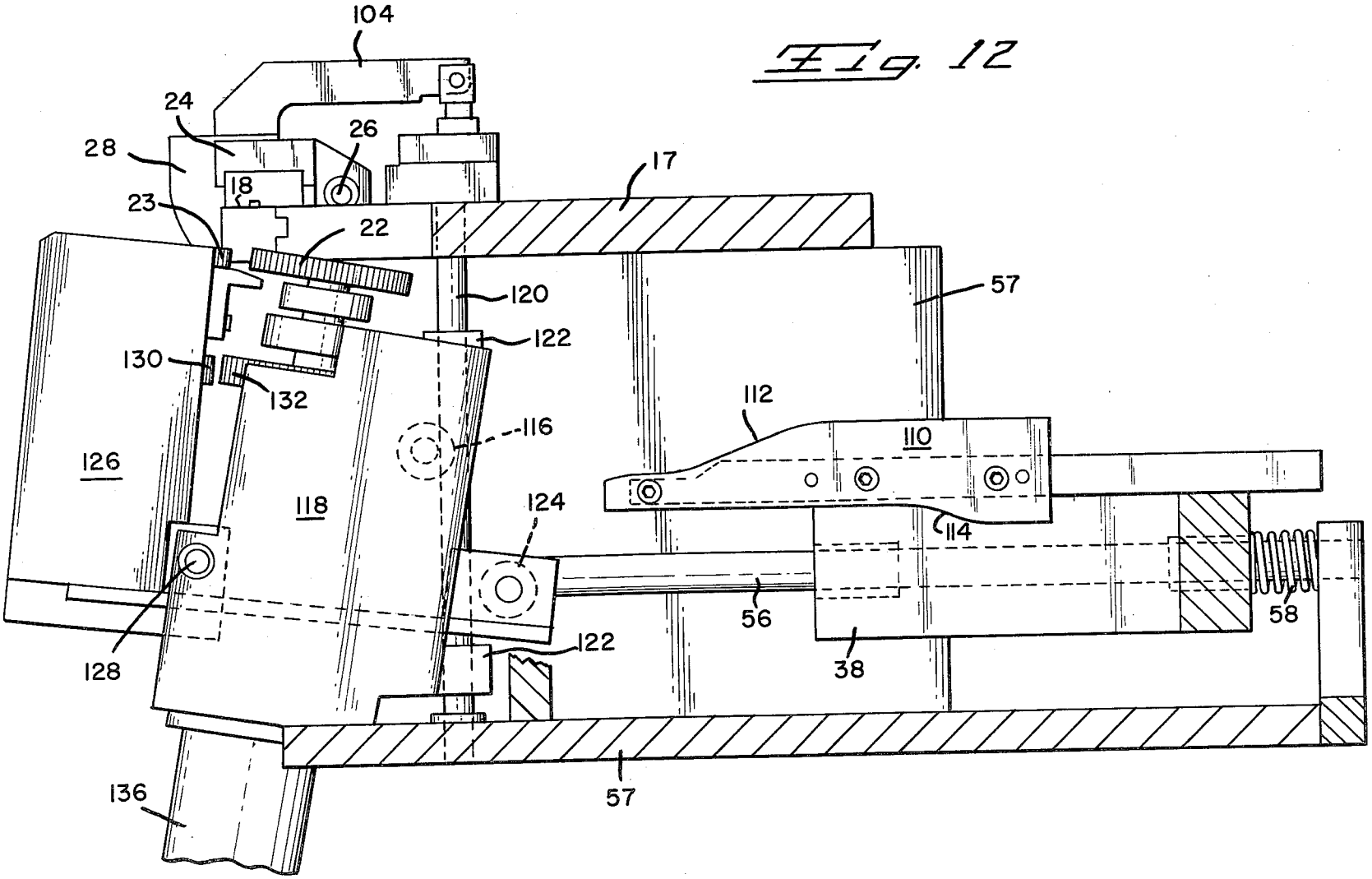
FIG. 12 is a partially cutaway side view taken at the beginning of the feed wheel cycle.
Figure 13:
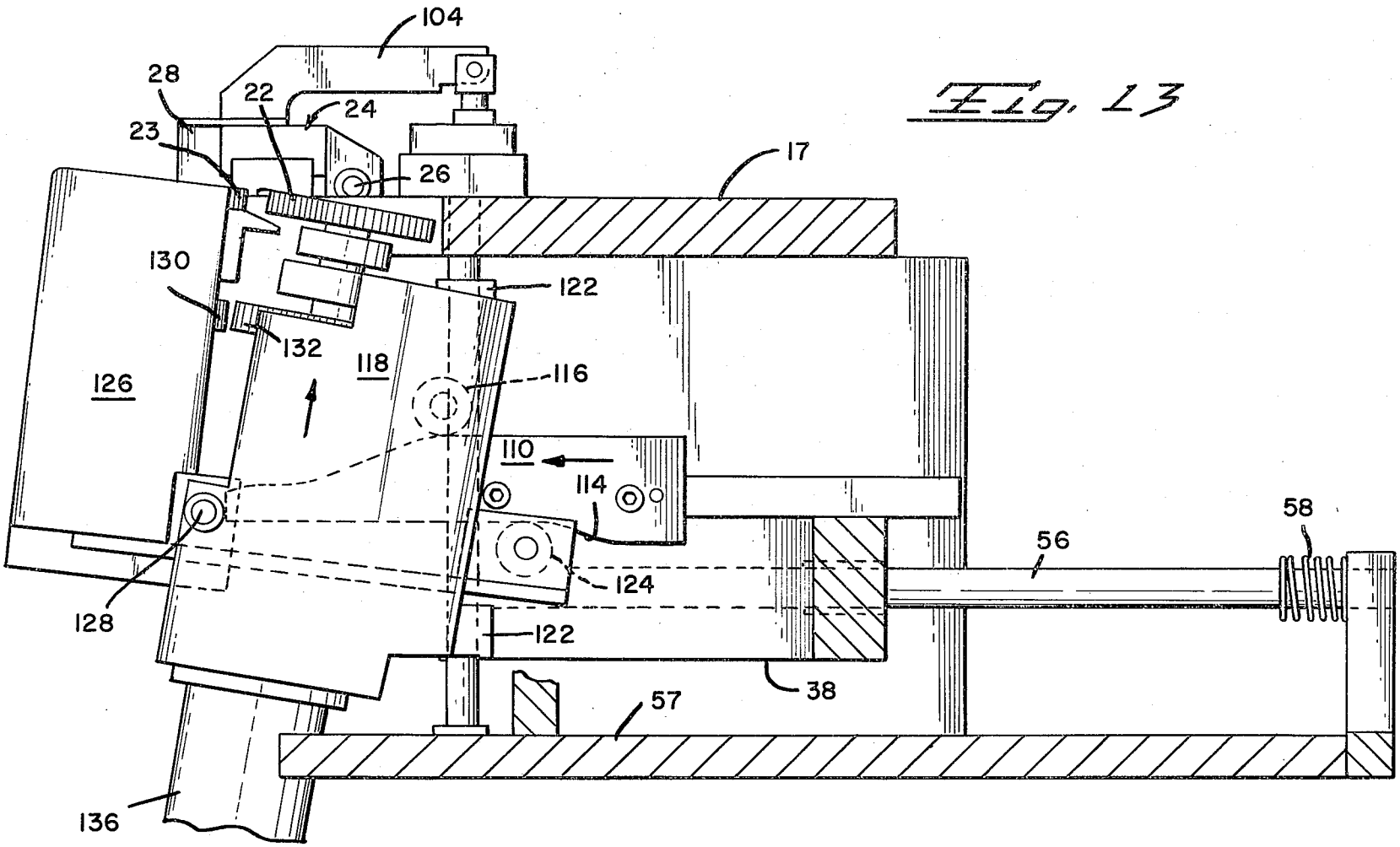
FIG. 13 is similar to FIG. 12, taken later in cycle.
Figure 14:
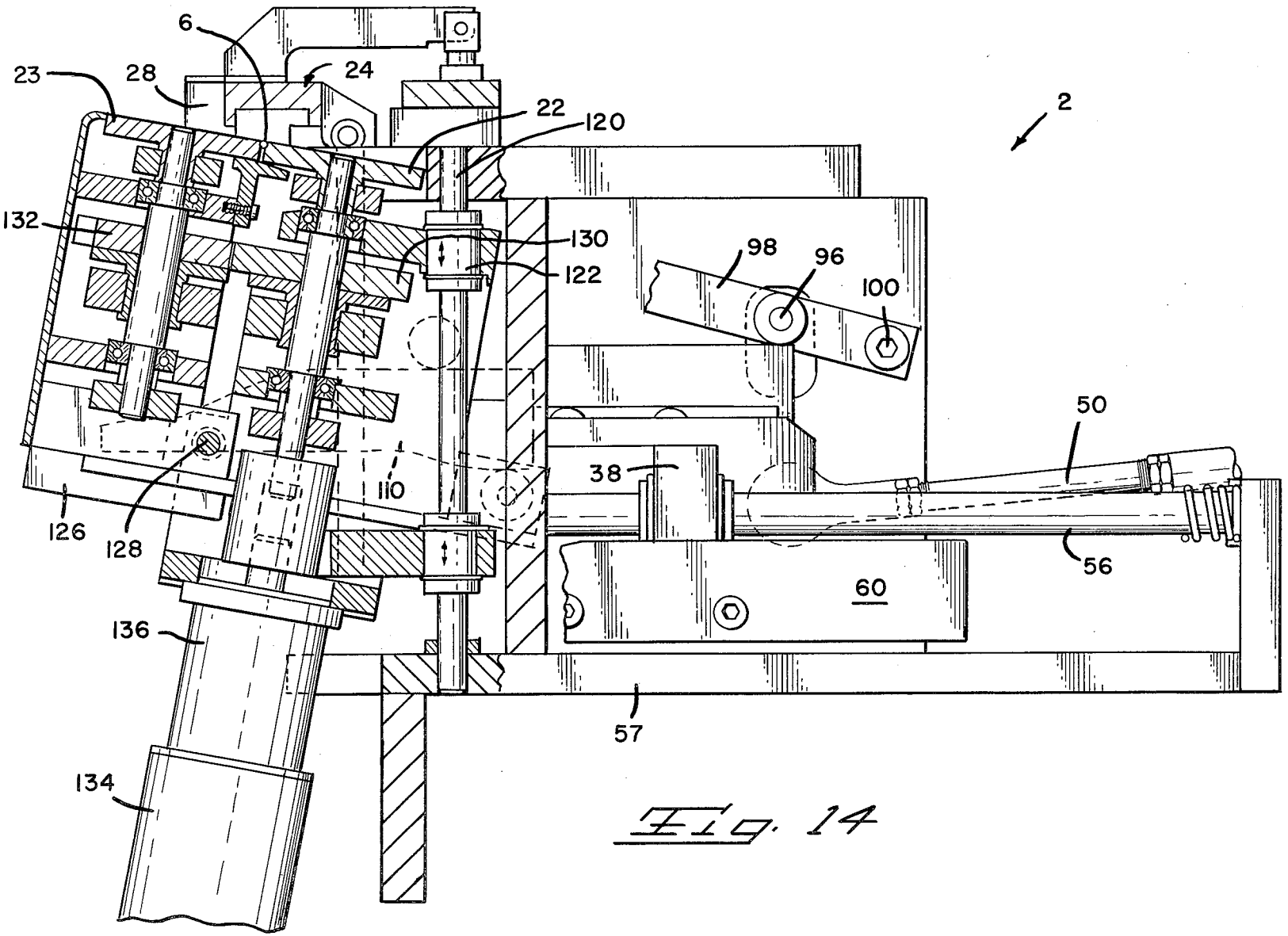
FIG. 14 is similar to FIG. 13, taken as feed wheels close on wire and gears engage.
Figure 15:
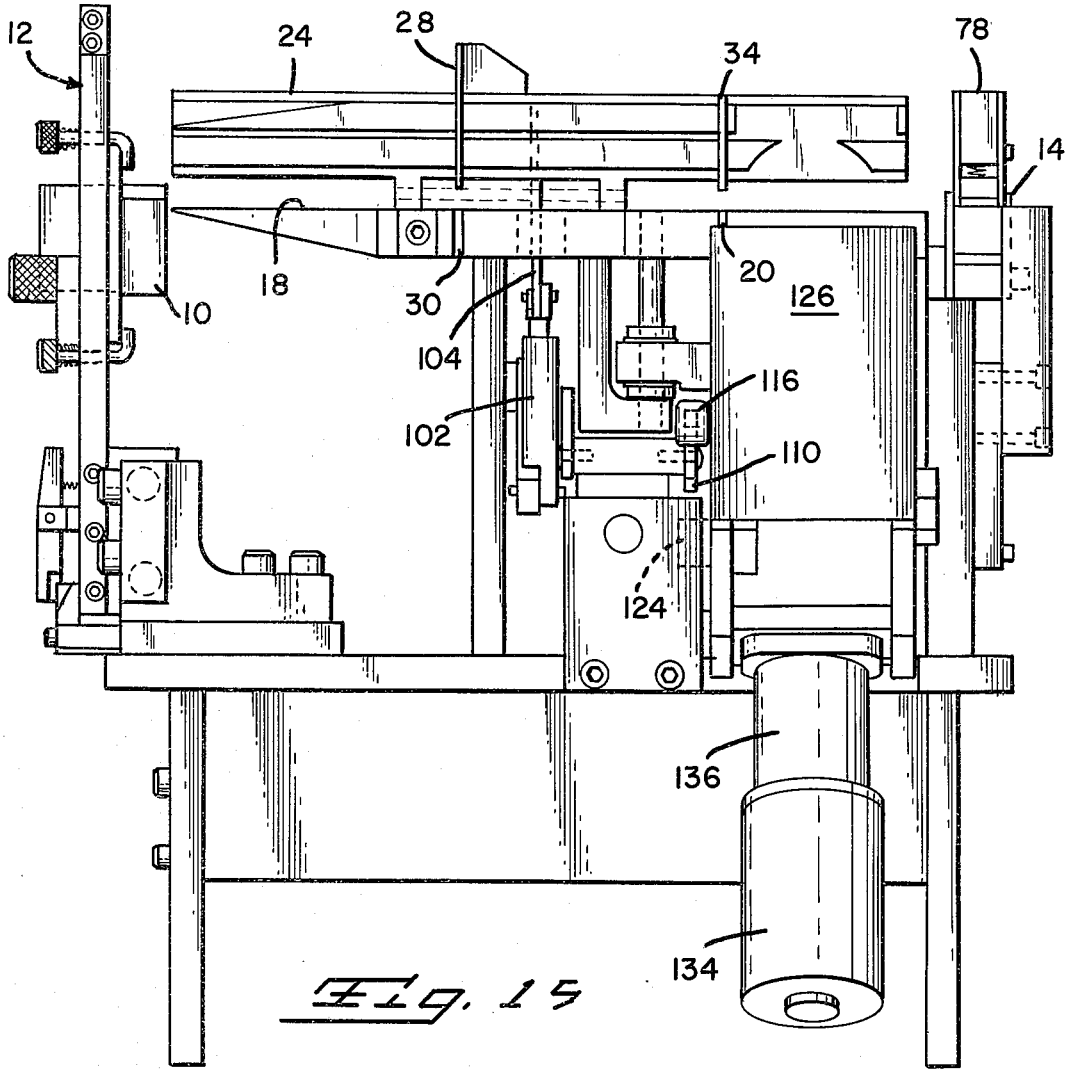
FIG. 15 is an end view of the block loader.
Figure 16:
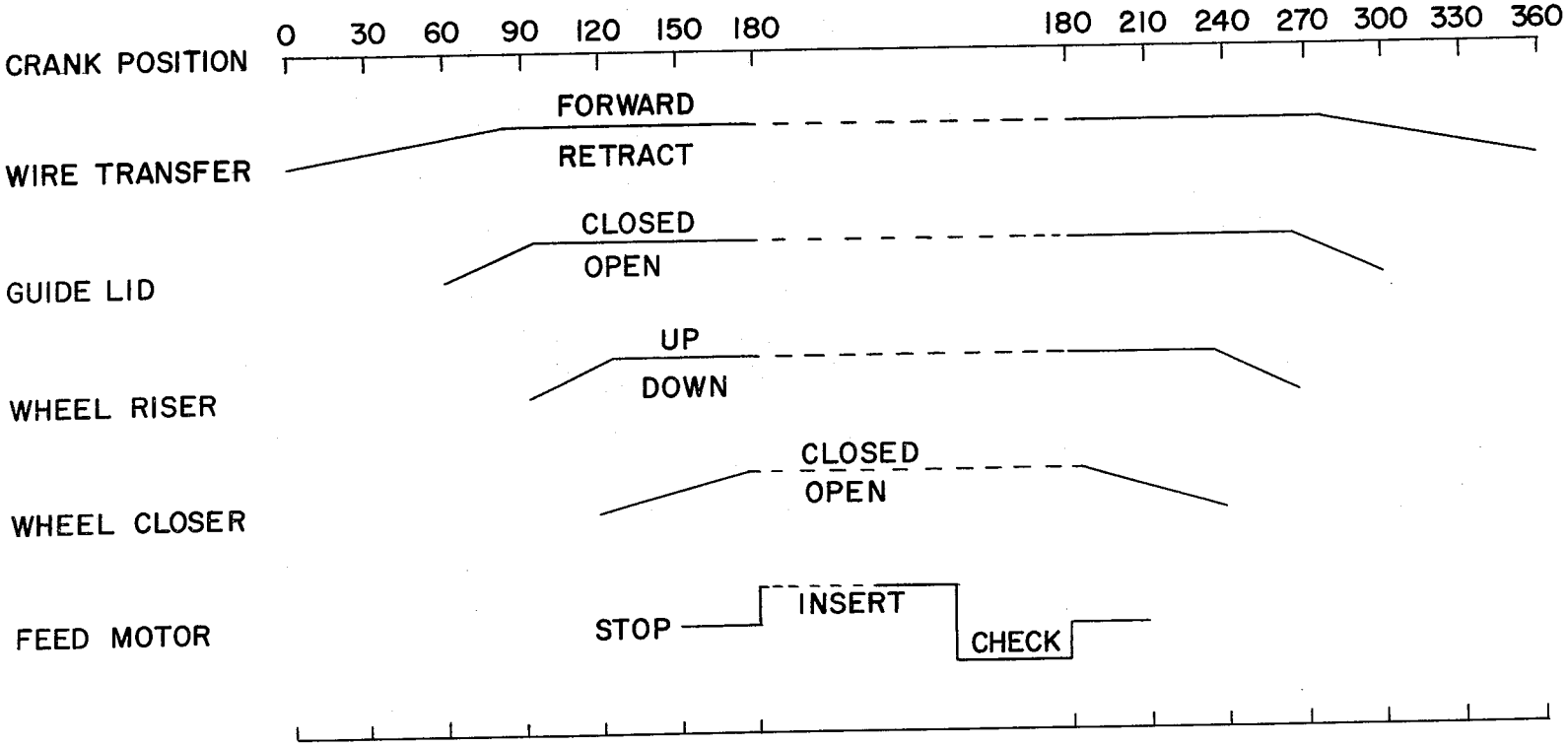
FIG. 16 is a timing diagram.

Referring now to FIG. 12, a feed wheel cam block 110, also fixedly mounted on the cam carriage 38, has a wheel riser cam 112 on the top of the block 110 and a wheel closer cam on the bottom of the block. The riser cam 112 acts on the riser cam follower 116 as the feed wheel cam block 110 moves to the left. This causes the vertical movement of wheel carriage 118 which is journaled to a vertical shaft 120 at journal boxes 122 mounted on the wheel carriage 118. The shaft 120 is fixedly mounted to the frame 57 of the block loader. The action of the wheel riser cam 112 raises the feed wheels 22, 23 to the position of FIG. 13, where they are ready to engage the wire for loading into the connector housing. At this point, the wheel closer cam 114 acts on the wheel closer cam follower 124 which causes slave wheel carriage 126 to pivot clockwise about closer pivot 128 so that the circumferential surfaces 32, 33 of the feed wheels 22, 23 engage the wire. This closing action also causes the slave wheel gear 130 to be fully engaged to the masterwheel gear 132 so that the electric motor 134 which drives the master feed wheel 22 via drive shaft 136 will also drive the slave feed wheel 23 but in an opposite direction. The arrangement of the wheels 22, 23 and gears 130, 132 in the wheel carriages 118, 126 is shown cross-sectionally in FIG. 14.

The timing of the above functions is indicated schematically in FIG. 19. The forward movement of cam carriage 38 is effected by a 180° rotation of crank shaft 44, at which point the clutch automatically disengages, which stops the movement of the carriage. Two limit switches (not visible) close when the machine is ready to insert wire in the connector housing; one is closed by the cam carriage at the limit of its advance, and the second is closed by the closure of the lid against the guide platform. These switches energize the feed motor 134, which operates at a preset speed to drive the feed wheels 22, 23 which feed the wire toward the connector housing.

After an initial delay of about 200 milliseconds after the feed motor 134 is energized, a forward current detector is enabled to detect the current rise when the motor load increases from inserting the terminal 4 into the housing 10. The starting current is quite high, as it must over come the inertia of the gears 130, 132, feed wheels 22, 23 and wire 6, so the 200 millisecond delay is interposed to differentiate starting current from insertion current. Insertion current is a measure of increased torque on the feed wheels which results from resistance met by the terminal entering the cavity, as, in a typical arrangement, the terminal penetrates a molded rubber gasket and retaining means in the cavity flex to snap over an annular retaining shoulder on the terminal. An example of this type is the rack and panel connector per ARINC Spec. 404, manufactured by AMP Incorporated as its AMP-INCERT connector line. These connectors employ typical pin and socket type terminals which do not require a particular radial orientation. It should be understood that the apparatus of the present invention may be used with terminals of different types by changing the profile of channel 36 as illustrated in the alternative embodiment of FIG. 2A. This would be suitable for loading square terminals such as the AMP-MODU contact described in U.S. Pat. No. 3,363,224.

When insertion current has reached a predetermined level, which is determined by insertion resistance as well as kinetic energy of the wheels and wire, the motor voltage is reversed by a solid state switch. For an adjustable period of time of about 30 milliseconds, the reverse current is only limited by armature resistance and available power. This phase is intended to stop the motor and remove the stored energy in the armature as quickly as possible, to prevent buckling of the wire in the tunnel and damage to insulation on the wire by circumferential surfaces 32, 33 of the feed wheels. The effect of kinetic energy of the gears, feed wheels and wire is small at this time since all components have slowed considerably during wire insertion if they are not actually stalled.

After the adjustable period concludes and the motor is stopped, the reverse voltage is maintained at a lower level by a torque limiting circuit which allows the armature to actually reverse direction and pull the wire with a preset force set by the operator. A successful insertion will stall the motor whereas an unsuccessful one will cause the wire to be retracted. The duration of the reversing portion of this cycle is adjusted by the operator and is set long enough to retract a bad insertion to whatever position is desired. The end of the reversing phase signals the clutch again and the crank 48 returns through 180° to complete the cycle.

An important feature of this invention is that a considerable resistance to terminal insertion may be overcome by wheels driven at some distance away. This is accomplished by a variety of factors, i.e., that both wheels are driven, for positive control, rather than having a single driven wheel and an idler; the tunnel is profiled to closely receive the wire, so that it does not buckle uncontrollably; and that the wire behaves ballistically, due to the velocity imparted to it by the feed wheels.

What is claimed is:

1. Apparatus for inserting terminals on the leading ends of electrical wires into terminal receiving cavities in an electrical connector housing, said cavities extending inwardly from one face of said housing, said apparatus comprising:

connector housing supporting means for supporting said connector housing in a predetermined position, guide means for guiding one of said wires axially therethrough, said guide means being disposed proximate to said housing, said guide means having one end spaced from said face of said housing and an other end substantially against said face, said guide means having a wire receiving tunnel extending from said one end to said other end, said tunnel having a cross section which is sufficient to permit free movement of said wire therethrough without significant lateral motion of said wire, a pair of feed wheels on said guide means proximate to said one end thereof, said feed wheels being driven at the same speed but opposite directions, said feed wheels having means for engaging circumferential surfaces thereof to said wire on opposite sides of a single point thereon, whereby the axial movement of said wire between said wheels and through said tunnel to insert the terminated end of said wire into one of said cavities is effected.

2. The apparatus of claim 1 wherein said feed wheels are driven by electric drive means, said drive means comprising a motor and associated circuit means, said circuit means comprising means for detecting an increase in torque on the feed wheels and means for stopping said feed wheels when said torque has reached a predetermined level, whereby, said feed wheels will stop when the terminated end of a wire is inserted in one of said cavities, said predetermined torque level being determined by resistance met by the terminated end of a wire when it is inserted in a cavity.

3. The apparatus of claim 2, wherein said means for stopping said feed wheels comprises a current reversing circuit set to operate for a predetermined time when the torque on the feed wheels reaches said predetermined level, said predetermined time being sufficient to stop the motor and remove the stored energy in the armature of the motor, whereby, said feed wheels stop almost instantly and buckling of the wire in the tunnel and damage to insulation thereon by said circumferential surfaces is prevented.

4. The apparatus of claim 1 having means for reversing said feed wheels after said leading end of said wire is inserted in said cavity, whereby a pull test may be performed to ascertain that said terminal on said leading end of said wire is retained in said cavity.

5. The apparatus of claim 1 wherein said guide means comprises a platform and a lid having means for closure of said lid to said platform, said lid having a channel therein, said channel positioned such that closure of said lid against said platform will form said tunnel therebetween.

6. The apparatus of claim 5 wherein said platform has a wire locating slot therein, said slot being profiled to receive a pair of wire locating fingers which extend perpendicularly from said lid which terminate at tips remote therefrom, said fingers having facing inner surfaces which converge from said tips to points immediately on either side of said channel, whereby placing a wire across said slot and closing said lid against said platform will align said wire between said inner surfaces and into said tunnel.

7. The apparatus of claim 5 wherein said platform has an ejector slot therein, said slot being profiled to receive an ejector arm which extends from said lid on one side of said channel to a tip on the other side of said channel and remote from said lid, whereby placing a wire across said slot and closing said lid against said platform will cause said arm to push said wire laterally of said channel and out of said tunnel.

8. An apparatus as in claim 5 which further comprises means for lateral delivery of said wires to said feed wheels, said lateral delivery, closure of said lid to form said tunnel, and engagement of said feed wheels to said wire being effected by the linear movement of a single cam carriage in a single stroke, said cam carriage having linear cams thereon which sequentially act on followers connected to linkage which acts on said means for lateral wire delivery, said means for lid closure, and means for engaging said circumferential surfaces of feed wheels to said wire.

* * * * *